US007874357B2

(12) United States Patent
Jalali et al.

(10) Patent No.: US 7,874,357 B2
(45) Date of Patent: Jan. 25, 2011

(54) DIAGNOSIS OF FORMATION CHARACTERISTICS IN WELLS

(75) Inventors: Younes Jalali, Cambridge (GB); Yannong Dong, Houston, TX (US); Huanwen Cui, Tulsa, OK (US); Shekhar Sinha, Oklahoma, OK (US); Rintu Kalita, Oxford (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 823 days.

(21) Appl. No.: 10/547,442

(22) PCT Filed: Feb. 27, 2004

(86) PCT No.: PCT/GB2004/000775

§ 371 (c)(1), (2), (4) Date: Oct. 26, 2006

(87) PCT Pub. No.: WO2004/076816

PCT Pub. Date: Sep. 10, 2004

(65) Prior Publication Data

US 2007/0038375 A1 Feb. 15, 2007

(51) Int. Cl.
*E21B 47/06* (2006.01)
*G01V 9/00* (2006.01)

(52) U.S. Cl. ..... 166/250.01; 702/12; 703/10

(58) Field of Classification Search ..... 166/250.01; 702/11, 12, 13; 703/10
See application file for complete search history.

(56) References Cited

U.S. PATENT DOCUMENTS

| | | | | |
|---|---|---|---|---|
| 5,992,519 | A * | 11/1999 | Ramakrishnan et al. | 166/250.15 |
| 6,691,037 | B1 * | 2/2004 | Poe et al. | 702/13 |
| 6,792,354 | B1 * | 9/2004 | O'Meara, Jr. | 702/2 |
| 2001/0023614 | A1 * | 9/2001 | Tubel et al. | 73/152.39 |

* cited by examiner

*Primary Examiner*—William P Neuder
(74) *Attorney, Agent, or Firm*—Brandon Clark; Rodney Warfford

(57) ABSTRACT

A technique for estimating the permeability profile of a well includes generating a well and formation model. The technique includes producing the well so that hydrocarbons flow from the formation and through the well. The technique includes measuring pressure at a plurality of points along at least a portion of the well without an intervention in the well and estimating a permeability profile along the portion of the well by use of the plurality of pressure measurements.

12 Claims, 9 Drawing Sheets

DIAGNOSIS OF FORMATION CHARACTERISTICS IN WELLS

BACKGROUND OF THE INVENTION

1. Field of the Invention

The invention generally relates to interventionless diagnosis of formation characteristics in wells.

2. Description of Related Art

After completion, it may be desirable to diagnose formation characteristics of the well for a number of reasons. For example, the diagnosis may provide a basis for well remediation and treatment, for the case when the well is in the appropriate condition to accept some form of treatment. Furthermore, the analysis may provide a basis for informed placement and construction of subsequent wells.

Diagnosing a well typically requires a "production logging" operation. This operation is an intrusive technique for horizontal wells and usually requires running a tool string on coiled tubing to access the horizontal section of the well. The use of production logging may be undesirable because the logging only provides a snapshot in time. Furthermore, production logging may only be applicable to a subset of the horizontal well population. For example, pumping wells typically cannot be logged unless they have a bypass mechanism; long horizontal wells typically cannot be logged because of coiled tubing access limitations; and subsea wells typically cannot be logged in a cost-effective manner because these wells require intervention vessels.

Thus, there is a continuing need for a noninvasive technique of production logging in wells.

BRIEF SUMMARY OF THE INVENTION

In an embodiment of the invention, a noninvasive technique of production logging for a well (a horizontal well, for example) is used. The technique includes, without intervening in the well, determining from pressure measurements that are conducted during the flowing of the well, a distribution of a formation characteristic in the vicinity of a wellbore. A model is used to determine from these pressure measurements a distribution of a characteristic (a permeability profile, for example) in the vicinity of the wellbore.

Advantages and other features of the invention will become apparent from the following description, drawing and claims.

DETAILED DESCRIPTION OF THE INVENTION

In accordance with embodiments of the invention, a technique to derive a permeability profile of a well (a horizontal well, for example) is performed without requiring physical intervention in the well. Instead of such intervention, the technique includes installing sensors ("permanent" sensors) in the well during the completion process, interrogating these sensors under controlled conditions during the production phase of the well, and applying certain mathematical techniques (multi-physics inversion in a dual-continuum media, or "inversion,") to measurements that are acquired from the sensors. More specifically, as set forth below, in some embodiments of the invention, the inversion technique is used to determine a permeability distribution indirectly from well measurements that have a close relationship with a near-wellbore permeability field. Thus, for example, a permeability profile may be derived from measurements that are made in a producing well.

In some embodiments of the invention, the permeability profile is derived for a horizontal production well by taking measurements of the flowing pressure in the well and using these measurements to invert a mathematical model to solve for the permeability profile. Moreover, in some embodiments of the invention, the technique described herein is "in-situ" and is a disturbance-free technique.

Figure 1:
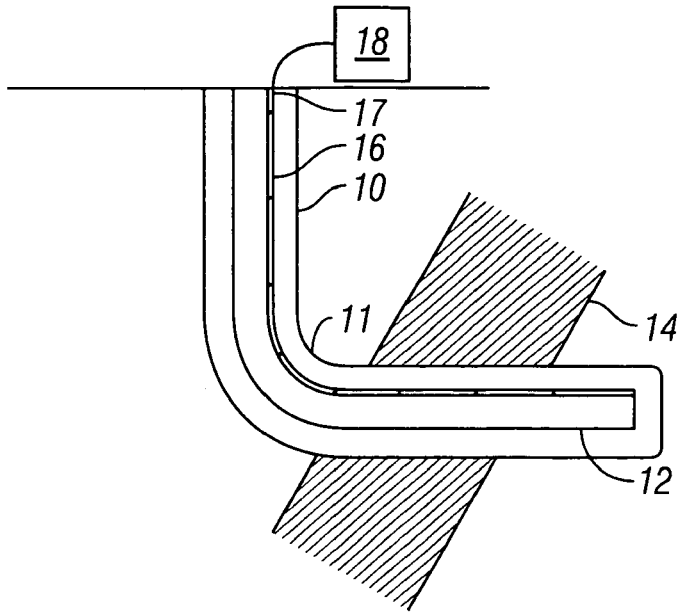
FIG. 1 is a schematic diagram of a horizontal well according to an embodiment of the invention.

Referring to FIG. 1, an embodiment of a horizontal well in accordance with the invention includes a main vertical wellbore 10 and a horizontal wellbore 11 that traverses a hydrocarbon formation 14. In some embodiments of the invention, the well may be a single horizontal well. As depicted in FIG. 1, a production tubing 12 extends through the vertical wellbore 10 and the horizontal wellbore 11. In some embodiments of the invention, a sensor 16 is mounted on the outside of the production tubing 12 and thus may be run into the well with the production tubing 12. In some embodiments of the invention, the sensors 16 may be "permanent" in that the sensors 16 are installed with the completion and provide sensed values during production without requiring intervention into the well.

The well depicted in FIG. 1 is one of many possible wells that may be used in accordance with the techniques described herein. These wells include horizontal wellbores that traverse homogeneous or heterogeneous formations, are subject to bottom-water drive, and are uniform sand completions, such as liner or screen completions. In some embodiments of the invention, the formation(s) traversed by the well may be unconsolidated.

The sensor 16, in some embodiments of the invention, may be deployed within the production tubing 12 or may be mounted to the outside of a well casing (not depicted in FIG. 1) that lines the vertical 10 and horizontal 11 wellbores. In some embodiments of the invention, the sensor 16 may be a pressure sensor that measures pressure at multiple points along the length of the well 10. In another embodiment of the invention, the sensor 16 may be a distributed sensor such that a pressure is measured along the length of the sensor. As a more specific example, in some embodiments of the invention, the sensor 16 may be a distributed temperature sensor that takes continuous measurements along the length of the sensor. The sensor may be electrical, mechanical or optical, depending the particular embodiment of the invention.

In some embodiments of the invention, the measurements that are made by the sensor 16 may be transmitted to the surface via a cable 17. It is noted that the sensor 16 may also include the cable 17. For example, in some embodiments of the invention, the sensor 16 may be an optical fiber that takes pressure measurements, as well as communicates these measurements to the surface. As depicted in FIG. 1, in some embodiments of the invention, the measurements from the sensor 16 may be received by a unit 18 that is located at the surface of the well.

Other sensors may be run into the well and may be used in connection with the sensor 16 or as a substitute for the sensor 16. For example, a temperature sensor may be into the well. In some embodiments of the invention, this temperature sensor may be integrated with the sensor 16; and in other embodiments of the invention, this temperature sensor may be separate from the sensor 16.

In accordance with some embodiments of the invention, a technique may be used to generate a profile of a formation characteristic in response to pressure measurements that are made by the sensor 16. As a more specific example, in some embodiments of the invention, the characteristic may be permeability; and a technique 30 that is depicted in FIG. 2 may be used to derive a permeability profile for the formation 14 (FIG. 1).

Figure 2:
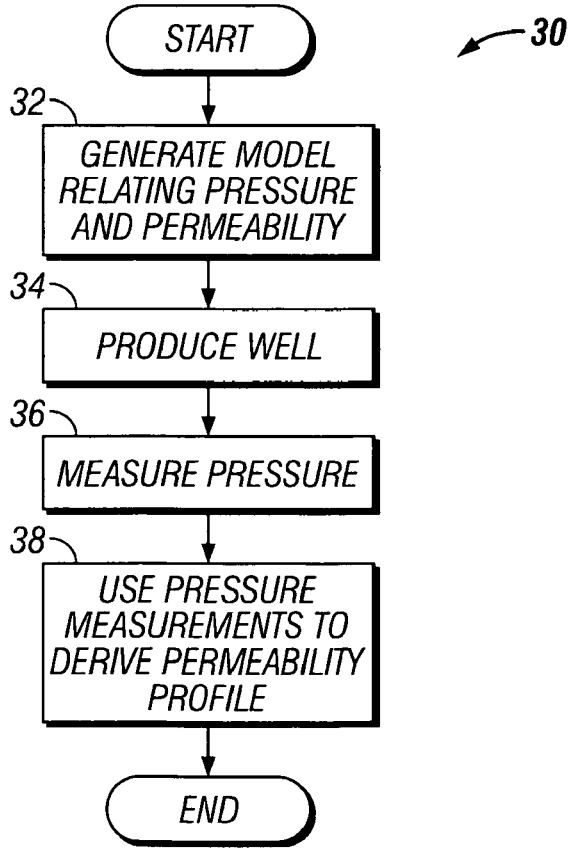
FIG. 2 is a flow chart depicting a technique to generate a permeability profile for the well of FIG. 1 according to an embodiment of the invention.

More specifically, referring to FIG. 2, in accordance with some embodiments of the invention, the technique 30 includes generating (block 32) a mathematical model that relates the pressure within the formation 14 to a permeability profile. This pressure is the pressure present in the well during flowing of the well. As described in more detail below, the mathematical model may be based on information relating to the well and the formation 14, such as the completion schematics of the well, near-wellbore information obtained, such as by wireline logging or logging while drilling, and far-field information obtained by field models, seismic studies, and anticipated production characteristics. The model establishes a relationship between the permeability and obtained pressure measurements.

The well is produced (block 34) so that hydrocarbons flow from the formation 14 through the well. This allows pressure measurements to be taken (block 36), and these pressure measurements, in turn, are used (block 38) as inputs to the mathematical model to derive a permeability profile for the formation in the vicinity of the horizontal wellbore 11.

In some embodiments of the invention, the model is initially generated using an estimate of the permeability profile for the well. As described further below, an iterative process is used to, based on the actual pressure measurements from the well, further refine the initial estimates to provide an inverted solution that yields the permeability profile for the well.

Based on the permeability profile obtained via the inversion technique that is described herein, corrective action may be taken within the well. For example, such corrective action may include treating the well with a repairable process. Furthermore, the permeability profile may be used as a basis for informed placement and construction of subsequent wells.

In some embodiments of the invention, the advantages of the techniques that are described herein may include one or more of the following. The techniques are non-invasive and therefore are applicable to horizontal wells that have thus far been impossible or difficult to log, such as pumping wells, subsea wells, and extended-reach wells. The sensors, being permanently mounted sensors, may be interrogated at any stage in the life of the well. More specifically, the sensors may be interrogated after commissioning of production to establish a baseline for subsequent diagnosis and to assess the effectiveness of the well construction process (i.e., assess the drilling, steering, completion, cleanup, and commissioning of the well). Furthermore, the sensors may be interrogated before and after any remedial or workover operation to assess the impact of the treatment on well performance.

Additionally, the techniques that are described herein reveal the reservoir-scale distribution of rock types (at a kilometer scale, for example) in the reservoir horizon, thereby providing important information concerning the placement and positioning of subsequent wells. More specifically, the techniques provide a high-resolution, hydraulic-based map of the permeability profile along the well trajectory. This is in contrast to the permeability logging by nuclear magnetic resonance (NMR) (which is high-resolution but non-hydraulic) imaging, and permeability estimation by dynamic formation testers (which are hydraulic but low-resolution, i.e., only available at discrete points along the well length).

Other and different advantages are possible in the various embodiments of the invention described herein.

As a more specific example, in some embodiments of the invention, the technique described herein estimates the distribution of permeability along the length of a liner-completed horizontal well from measurements of well flowing pressure at multiple points along the path of flow in the wellbore. The technique may apply to flow under nontransient or stabilized conditions and yield estimates of permeability along a well trajectory in the principal directions that are normal to the well path. Therefore, estimates of horizontal permeability that are perpendicular to the well orientation and vertical permeability may be obtained for the formation that is intersected by the well. Estimation accuracy may improve when the geometric mean of the normal permeabilities is obtained, as opposed to their individual values. This permeability group is what governs the influx into the well.

In some embodiments of the invention, the effect of skin is ignored, but the technique may be used to invert for a piecewise well index coefficient that is proportional to the permeability group and is inversely proportional to skin. Therefore, the techniques described herein may generate the longitudinal profile of a parametric group that represents the quality of the formation and the integrity of the completion.

Among the advantages of the technique described herein, with the advent of permanent sensing technologies and the development of methods of production data inversion or history-matching, a new form of cased-hole diagnosis may be envisaged, with improved spatial and temporal coverage, without the need for in-well intervention and interruption of production. The impact of this technique on reservoir-scale characterization can also be significant.

There are two main preconditions for the development of such methodology, one concerning sensing technology, the other interpretation methodology. Permanent sensing technology has made great progress during the last decade, with the development of single-point and distributed measurements that can be deployed with the completion (pressure, flow rate, and distributed temperature). However, these systems are typically developed as stand alone units, and do not enjoy the required degree of integration. One reason for this, besides the basic drive for the development of discrete measurements of high metrological performance for direct diagnosis of flow conditions, is the absence of a methodology to determine what combination of measurements are required to resolve anticipated flow problems. Today, basic modeling tools required to arrive at such determination are available, although an efficient methodology for such analyses has yet to be developed. Thus, the basic problem that is addressed by the embodiments described herein is the determination of the characteristics or type of sensors that are needed for a particular application.

In some embodiments of the invention, the well diagnosis problem is decoupled to diagnose the flow condition of the wellbore and diagnose the near-wellbore formation characteristics. In this context, the "near-wellbore" means the portion of the well that falls within the wellbore gridblock scale. This is partly to adhere to the conventional demarcation between production logging and formation evaluation, and partly is a natural consequence of the mathematical problem. However, although the wellbore diagnosis problem (determination of flux distribution as in production logging) can treat the formation simply as a boundary condition, the formation evaluation problem cannot do the same, as evaluation is based on measurements made inside the wellbore. Thus both media, porous and nonporous, may be taken into account.

In some embodiments of the invention, the mathematical model assumes a coupled wellbore-reservoir system, where wellbore hydraulics is taken into account through a multiphase flow model that accounts for slippage between the phases but not segregated flow patterns. This flow model has been found to agree relatively well with nontransient liquid flow in horizontal conduits. A particular advantage of such a model is that it allows a fully implicit coupling of the reservoir and the wellbore. In some embodiments of the invention, care must be taken to analyze with the coupled model, as there are certain flow problems for which this is the only applicable wellbore flow model. This precludes use of this model, for example, for transient or segregated-flow problems.

Alternatively, in some embodiments of the invention, a more elaborate flow model for the well may be used, but the model may become considerably more complex. Thus, in some embodiments of the invention, the model used in block 32 of the technique 30 (FIG. 1) adheres to the simple drift flux model for multiphase flow in the wellbore.

In the following example, the well has the following parameters. In particular, the well may have either a homogeneous or a heterogeneous reservoir that is subject to bottom water-drive. Furthermore, the model takes into account formation anisotropy and model normal crude properties. The liner is assumed, for purposes of this example, to have a completion length of 2000 feet that drains the reservoir at a constant liquid rate of 10,000 STB/day. The basic parameters of the model are summarized in the following Table:

TABLE 1

Basic Parameters of the Wellbore-Reservoir Model

| | |
|---|---|
| Model Dimensions | 4000 × 3000 × 360 feet |
| Grids (uniform) | 20 × 15 × 9 |
| Permeability $K_x$, $K_y$, $K_z$ (base case) | 200, 200, 100 md |
| Porosity $\phi$ | 0.15 |
| Connate Water Saturation $S_{wc}$ | 0.2 |
| Critical Gas Saturation $S_{gc}$ | 0 |
| Oil Relative Permeability $K_{ro}$ ($S_w = S_{wc}$) | 0.8, 1.0 md |
| Water Relative Permeability $K_{rw}$ ($S_w = 1$) | |
| Liquid Phase Relative Permeability $K_{r-liq}$ ($S_g = S_{gc}$) | 0.8, 0.9 md |
| Gas Relative Permeability $K_{rg}$ (Sg = 1 − $S_{wc}$) | |
| Oil Density $\rho_o$ | 35 lbm/ft$^3$ |
| Oil Viscosity at bubble point pressure $\mu_{ob}$ | 1 cp |
| Oil Formation Factor at bubble point $B_{ob}$ | 1.2 RB/STB |
| Solution Gas-Oil Ratio at bubble point pressure $R_{sb}$ | 1.13 scf/STB |
| Bubble Point Pressure $P_b$ | 2800 psi |
| Initial Reservoir Pressure $P_i$ (at OWC) | 4000 psi |
| Well Placement (heel to toe grids) | (6, 8, 6) to (15, 8, 6) |
| Well Standoff (to OWC) | 140 feet |
| Well Length | 2000 feet |
| Well Inner Diameter | 0.25 feet, 0.45 feet |
| Well Roughness | 0.001 feet |
| Well Rate | 10,000 RB/Day |

The model assumes that the wellbore is divided into segments to compute the wellbore flowing pressure along the length of the well at any time-step. The well is divided in to as many segments as there are gridblocks intersected by the well, which is ten in this example (although more group blocks are possible in other embodiments of the invention and in other examples). Every other well segment is deemed to contain a pressure measurement node. Therefore, it is presumed for this example that there is a sensor spacing of approximately 400 feet.

The pressure profile of the well is generated under stabilized conditions and examines pursuant to a given time-step to estimate the wellbore-gridblock permeability profile. Furthermore, the model is examined to determine how this profile may be estimated by simultaneous inversion of the pressure profile at multiple times.

The observed wellbore pressure data is from a "true" reservoir model. Thus, the analysis described herein involves how to define the "true" permeability distribution based on the pressure observation data. The technique involves providing an initial "guess" of the permeability profile. In some embodiments of the invention, if the wellbore pressure data from any other reservoir models are the same as the observed pressure data under certain error limits, then these reservoir models may be seen as "true" models of the permeability distribution. The technique of obtaining the permeability distribution from the observed pressure measurements, in some embodiments of the invention, uses a least-square error method.

In some embodiments of the invention, a perturbation technique is used to determine the sensitivity of the wellbore pressure at each segment to the formation permeability at each gridblock that is intersected by the well. This is done numerically by using the coupled wellbore-reservoir model. The sensitivity coefficient is computed with respect to permeability along three principal axes (the x-direction, parallel to well orientation; and the y- and z-directions normal to well cross-section). Thereafter, a gradient-based optimization technique is used to minimize the mismatch between measured and computed wellbore pressures, using the information on sensitivity coefficients and an initial guess of the wellbore permeability profile. This is done iteratively until a determination criterion is reached.

The following is a description of the parameters used for the inversion. In some embodiments of the invention, the mathematical model of the wellbore pressure response is derived by a numerical simulator that accounts for the coupling of the reservoir and the wellbore through a connection factor. The connection factor for a horizontal well geometry, where the well is aligned along the x direction is given by the following equation:

$$CF = \frac{d_x(k_y k_z)^{1/2}}{\ln(r_o / r_w) + S} \quad \text{Equation 1}$$

where "CF" is the connection factor, "$d_x$" is the length of the gridblock along the x direction, "$k_y$" and "$k_z$" are the permeabilities normal to the well cross-section, "S" is the skin, "$r_w$" is the wellbore radius, and "$r_o$" is the radius at which the pressure corresponds to the "reservoir" pressure. It is noted that the "$r_o$" is a function of the gridblock dimensions and the permeabilities in the y and z directions.

In some embodiments of the invention, the skin effect is neglected and Equation 1 is inverted for the $k_y$ and $k_z$ permeabilities. After the inversion, the geometric mean of these permeabilities is computed, i.e., $(k_y*k_z)^{1/2}$. In some embodiments of the invention, the entire connection factor may be inverted, which, for all practical purposes, is the productivity index of the wellbore-gridblock times viscosity.

The inversion is performed in the following manner. First, the following objective function is defined:

$$f = \sum_{i=1}^{N} (P_{wfo,i} - P_{wfc,i})^2 \quad \text{Equation 2}$$

where "$P_{wfo,i}$" denotes the observed wellbore pressure of the $i^{th}$ segment, and "$P_{wfc,i}$" is the corresponding calculated wellbore pressure. The wellbore pressures may be calculated with the multisegment facility of Eclipse, a well simulation software package described in Holmes, J. A., Barkve, T., and Lund, O.: "Application of a Multisegment Well Model to Simulate Flow in Advanced Wells", paper SPE 50645, presented at the 1998 European Petroleum Conference, the Hague, 20-22 Oct. 1998, incorporated herein by reference. "N" represents the number of wellbore segments in which flowing pressure may be measured.

The gradient of the objective function with respect to the permeability of the $j^{th}$ wellbore gridblock is given by the following equation:

$$\frac{\partial f}{\partial k_j} = -2\sum_{i=1}^{N} (P_{wfo,i} - P_{wfc,i}) \frac{\partial P_{wfc,i}}{\partial k_j} \quad \text{Equation 3}$$

Equation 3 contains the derivative of wellbore pressure to the gridblock permeability. Stated differently, this is the sensitivity coefficient and is calculated by the perturbation technique. The sensitivity of wellbore pressure at the $i^{th}$ segment to the $j^{th}$ wellbore gridblock permeability is given by the following relationship:

$$\frac{\partial p_{wfc,i}}{\partial k_j} = \frac{p_{wfc,i}(k_j + \delta k_j) - p_{wfc,i}(k_j)}{\delta k_j} \quad \text{Equation 4}$$

where "$\delta k_j$" represents the perturbation of "$k_j$." In the perturbation technique, the magnitude of the perturbation may be important for the accuracy of the sensitivity. The magnitude may be determined by numerical experimentation.

To minimize the objective function f, a non-linear optimization algorithm is used in some embodiments of the invention. In particular, in some embodiments of the invention, the Levenberg-Marquardt technique is used. Using k as the vector of model parameters, the iterative equation is set forth below:

$$[H(k^l) + \mu^l I]\delta k^{l+1} = \nabla_k f(k^l) \quad \text{Equation 5}$$

where "$\delta k$" represents the parameter incremental vector, "$\nabla_k f(k^1)$" represents the gradient vector, "$H(k^1)$" represents the Hessian matrix, "I" represents a unit diagonal matrix, "$\mu$" represents the damping factor, and "l" represents the iteration number. The convergence criterion for the Levenberg-Marquardt technique is set forth below:

$$|f(k^{l+1}) - f(k^l)| \le \varepsilon \quad \text{Equation 6}$$

where "$\epsilon$" represents a small number supplied by the user of the model. Upon convergence, the model is inverted for the permeability profile.

The far-field effect may be minimized as follows. If "k" is the vector of parameters to be estimated, k may be defined as follows:

$$k=[m_k \alpha]^T \quad \text{Equation 7}$$

where "$m_k$" represents the column vector that represents the permeabilities ($k_y$ and $k_z$) of the gridblocks penetrated by the well, and "$\alpha$" represents a multiplier for the rest of the permeability field. The estimation of the $\alpha$ multiplier along with $m_k$ allows for the adjustment of far-field values along with $m_k$. Otherwise, $m_k$ may need to be accommodated for the disparity between the assumed and true states of the reservoir permeability field. The introduction of a may be significant when late-time pressure data is used for the inversion.

Imperfect information about the key parameters used in the inversion may affect the quality of the inversion. Such imperfect information may include imperfect measurements, imperfect knowledge of wellbore hydraulics and imperfect knowledge of the reservoir permeability field. The quality of the inversion may also be affected by relative permeability. As set forth below, the impact of each parameter individually on the quality of the inversion is first demonstrated and then the combined affect is discussed.

Figure 3:
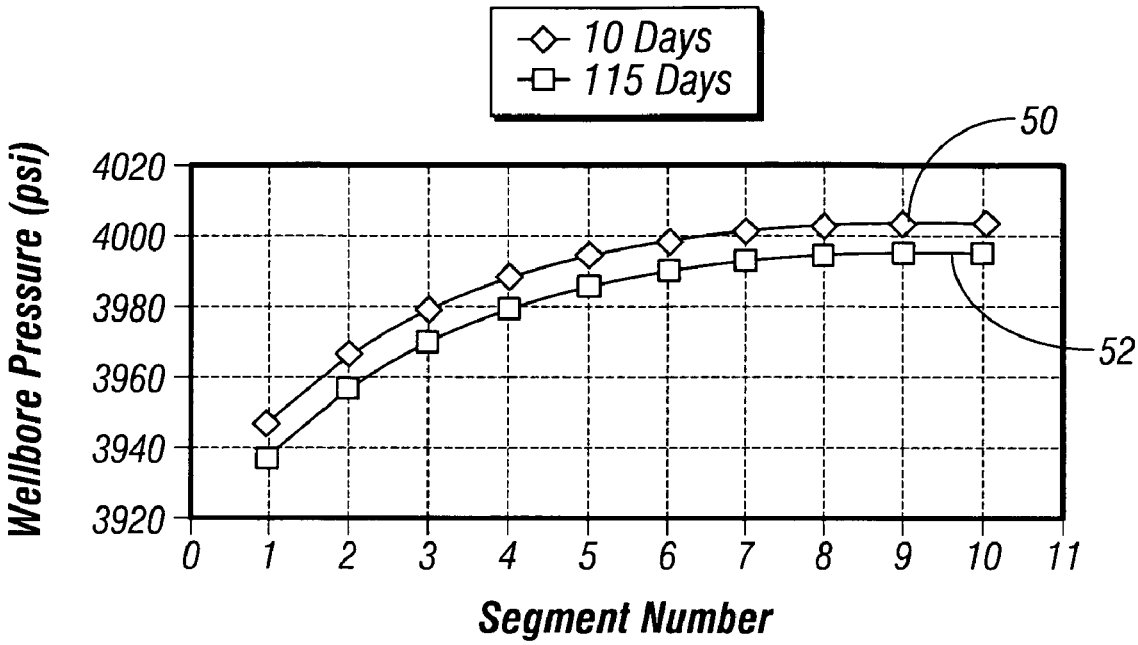
FIG. 3 is a graph depicting a wellbore pressure at two different times.

FIG. 3 depicts wellbore pressure profiles 50 and 52 of the well 10 and 115 days after initial production The rate of pressure drop along the well length is governed by the rate of increase of fluid velocity in the liner. The pressure gradient, therefore, is governed by the distribution of influx into the wellbore. The latter is in turn governed by the permeability profile along the well length. The decline in the pressure profile over time is caused by the decline in fluid mobility in the formation with the onset of two-phase flow (relative permeability). Thus, drawdown has to increase to supply the same rate to the well, given the reduced mobility of fluids in the formation.

Figure 4:
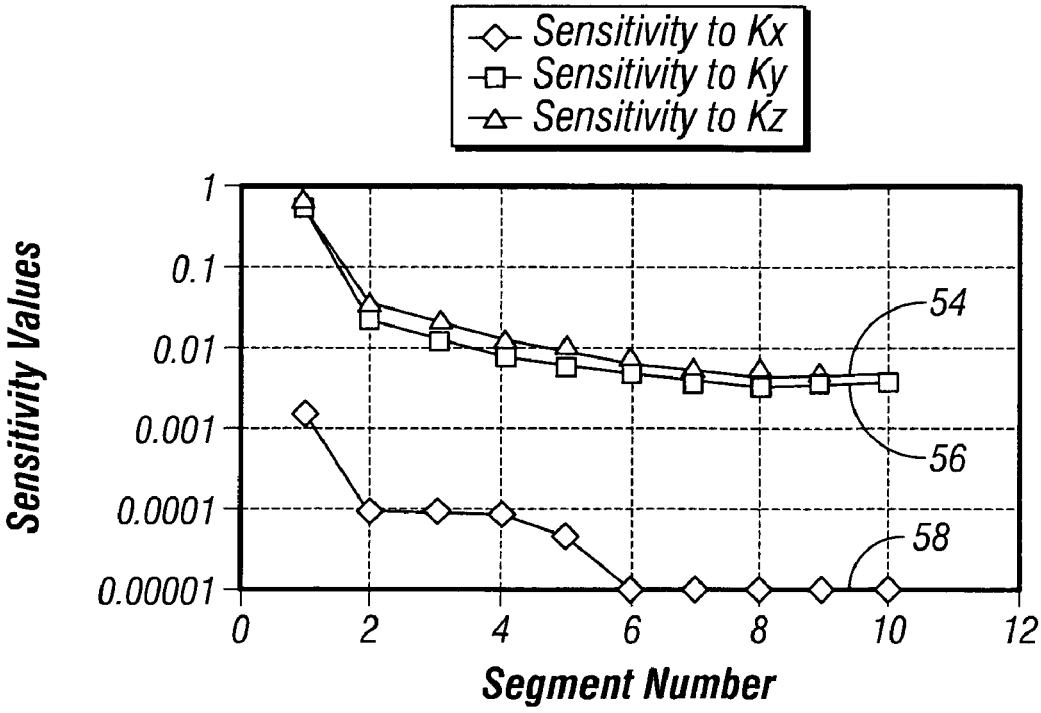
FIG. 4 is a graph depicting sensitivity of segment pressure to gridblock permeability along a path.

FIG. 4 depicts sensitivity graphs 58, 56, and 54 to the $k_x$, $k_y$, and $k_z$ permeabilities, respectively. These sensitivities are measured in the heel segment of the wellbore to the permeability of gridblocks traversed by the well. Permeability along the three principal directions is taken into account. The sensitivity of wellbore pressure to axial permeability (with respect to the well orientation, x direction) is much lower than that to normal permeabilities. This is physically sensible because the well is principally fed along streamlines normal to the circular cross-section of the well. Also, wellbore pressure in each segment is most sensitive to the permeability of its adjacent gridblock. With increasing distance of gridblocks from the measurement point (along well length), sensitivity decays. This means that the resolution of the permeability inversion is governed by measurement density.

Figure 5:
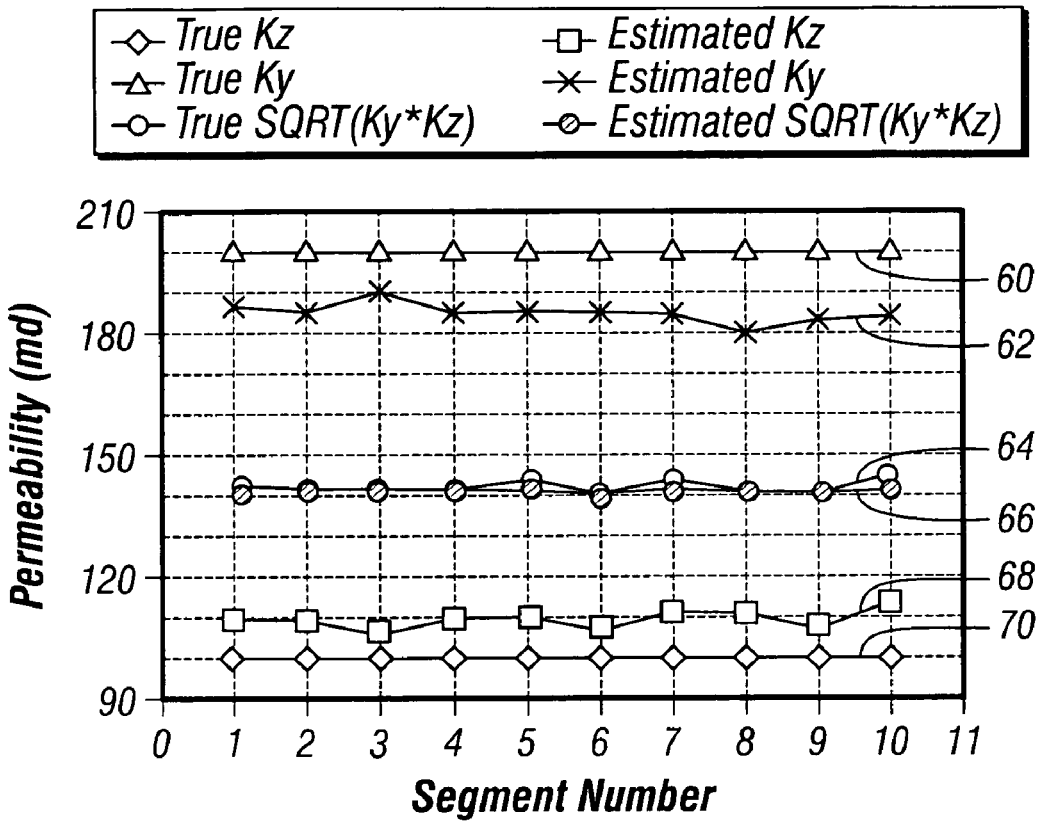
FIG. 5 is a graph depicting estimations of permeabilities normal to the well path and the geometric means of these estimations.

FIG. 5 depicts graphs 60, 62, 64, 66, 68, and 70 of the following parameters used in the inversion of the permeability normal to the well path for a homogeneous anisotropic problem. Early time data (10 days) was used. The true permeabilities are 200, 200, and 100 md along the x, y, and z directions, as depicted by the plots 60 and 70 for the y and z directions, respectively. The initial guesses were approximately 150, 150, and 50 md, respectively. The estimations of $k_y$ and $k_z$ permeabilities are about 185 and 110 md, respectively, as indicated by plots 62 and 68, respectively. The $k_x$ permeability is not estimated and remains at the initial guess. Although the estimated permeabilities deviate from the true permeabilities, their geometric mean closely tracks the true mean, as depicted by plots 64 and 66 in FIG. 5. This is because the geometric mean governs the influx to the well, which, in turn, governs the pressure profile. For the remainder of the examples, the geometric mean is contrasted to the true mean. Also, unless otherwise stated, the results pertain to early time inversion, i.e., 10 days.

As described above, inversion may also incorporate the concept of skin, such that for each wellbore gridblock the ratio of geometric mean of normal permeabilities to a term containing the skin is estimated. This would be similar to estimation of the productivity index of wellbore gridblocks. Although the total parametric group cannot be resolved into its constituent parameters (without additional information), the variation of this composite group along well length is informative of the quality of the wellbore-reservoir coupling and the condition of the completion.

Figure 6:
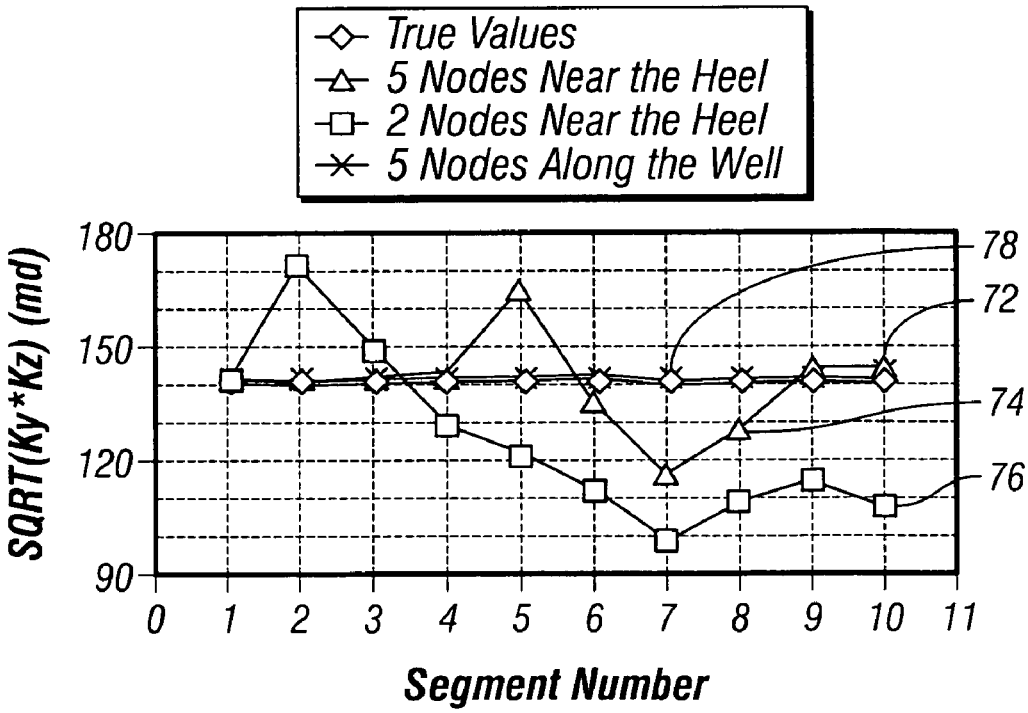
FIG. 6 is a graph showing the effect of measurement density on permeability estimation.

FIG. 6 depicts the impact of measurement density on the quality of inversion. The graph 78 of FIG. 6 depicts the true values of $k_x$ and, as shown, the best results occur with five nodes along the well, as depicted by graph 72. For this scenario, every other well segment is instrumented with a pressure sensor. As depicted by the graphs 74 and 76, the results become less accurate for five nodes near the heel and two nodes near the heel, respectively. It can therefore be suggested that due to the partial sensitivity of the wellbore segment pressure to nonadjacent gridblocks, the spatial resolution of permeability profile is greater than the spatial density of pressure measurements. The spatial density of measurements required for any application, however, is determined by the degree of variability of the permeability profile in the longitudinal direction.

Figure 7:
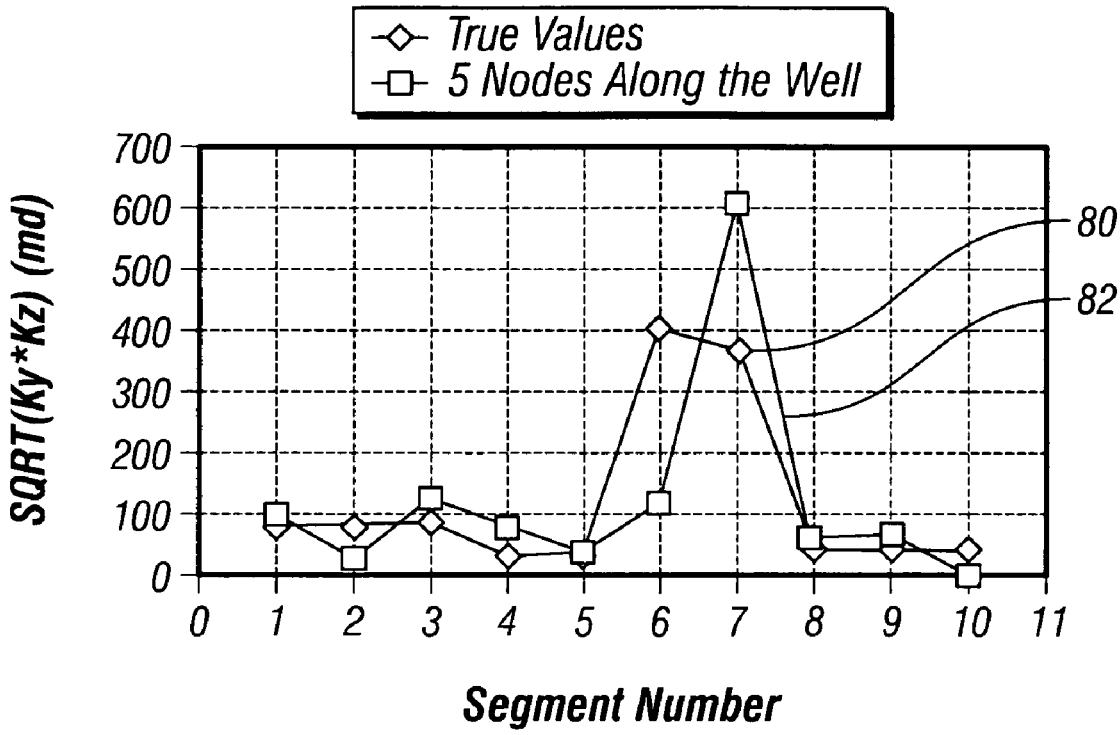
FIG. 7 is a graph depicting an estimation of a permeability profile for the scenario in which pronounced variations are present along the well length.

FIG. 7 depicts the inversion of the five-node configuration (depicted by the graph 82) when sharp permeability variations exist along the well path. This is to be contrasted to a graph 80 depicting the true values. Sharp permeability variations may exist when the well transverses a formation with bedding planes, which creates lateral variation of facies along the well path. Fractured intervals may produce the same effect. Here, the estimated and true profiles deviate, although the general character of the permeability profile is captured fairly well.

Figure 8:
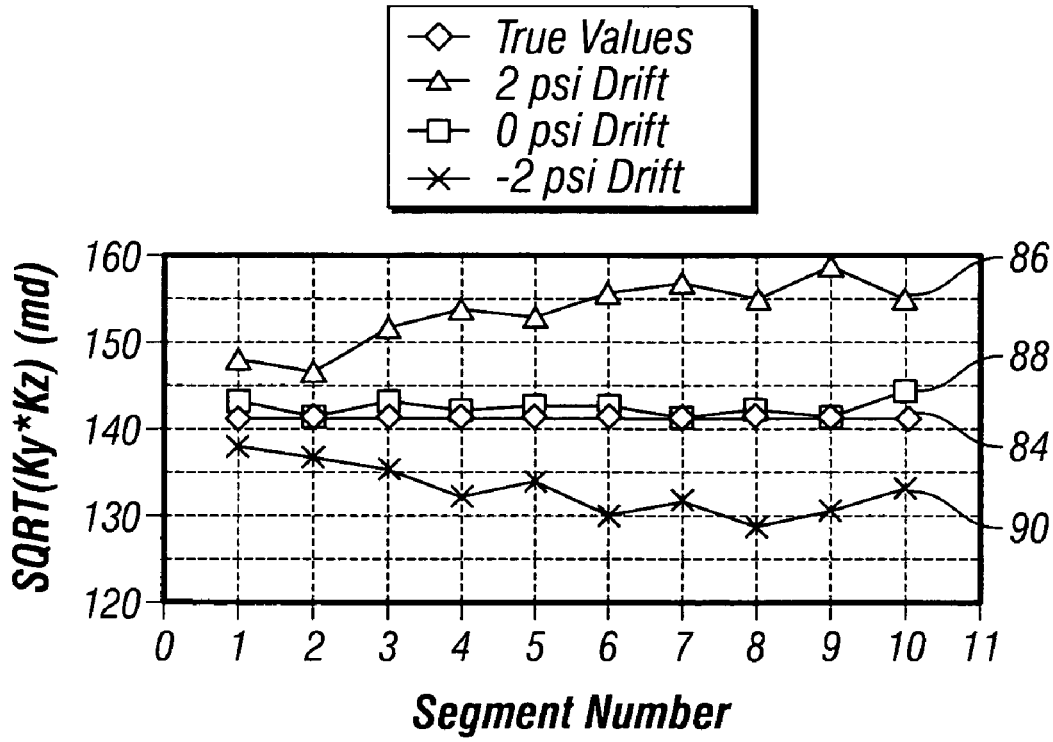
FIG. 8 is a graph depicting estimations of permeability profiles for uniform drifts.

FIG. 8 depicts the inversion of a five-node configuration (a homogeneous anisotropic example) when the sensors experience uniform drift. More specifically, graph 84 depicts the true values, graph 88 depicts a zero pounds per square inch (psi) drift, graph 86 depicts a 2 psi drift, and graph 90 depicts a −2 psi drift. A negative drift, i.e., when a pressure lower than true pressure is measured, causes an underestimation of permeability. This is because negative drift exaggerates the actual drawdown, which has to be compensated by reduced permeability to respect the true production rate of the well. Likewise, positive drift overestimates the permeability. In either case, however, the permeability trend is reasonably captured.

Figure 9:
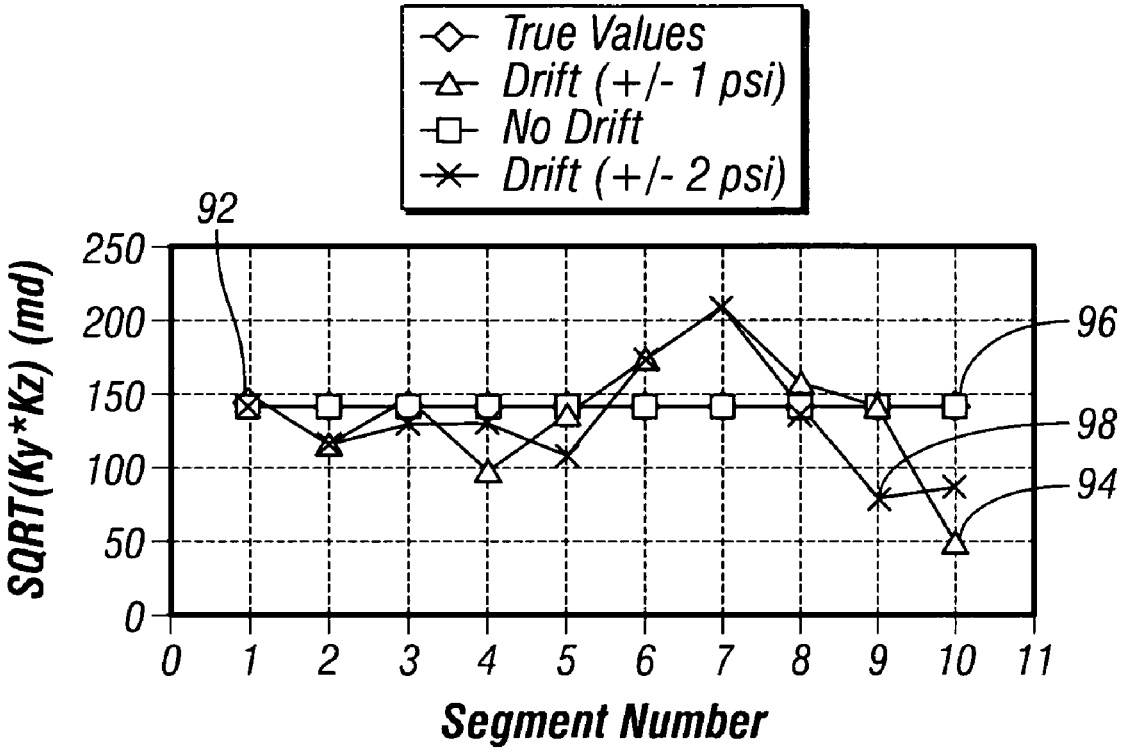
FIG. 9 is a graph depicting estimations of permeability profiles for nonuniform drifts.

FIG. 9 depicts inversion when the sensors experience non-uniform drift. This is modelled as an oscillation of ±1 psi or ±2 psi from the true value. Therefore, this simulates uncorrelated drift amongst the nodes. As shown in FIG. 9, graph 92 depicts the true values, graph 96 depicts no drift, graph 94 depicts a drift of ±1 psi, and graph 98 depicts a drift of ±2 psi. A comparison of FIGS. 8 and 9 indicates that the quality of the inversion is determined by the relative accuracy of the pressure measurements. The drift problem, therefore, must be addressed by calibration of pressure measurements when there are interruptions to production. Upon decay of transients, all nodes must read the same value, unless the well undulates through the formation, or a regional pressure gradient exists in the reservoir.

Figure 10:
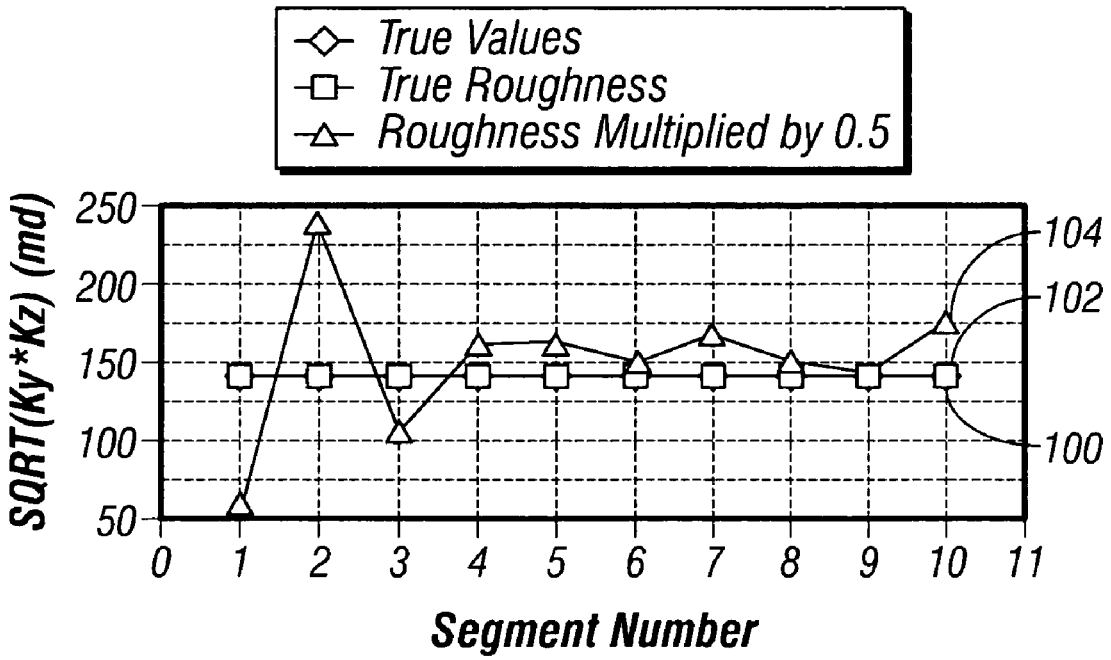
FIGS. 10 and 11 are graphs depicting estimations of permeability profiles with imperfect knowledge of wellbore hydraulics.

FIG. 10 depicts the inversion of the permeability group for the five-node configuration with "drift-free" measurements, but when knowledge of wellbore hydraulics is imperfect. As depicted in FIG. 10, the true values are indicated by a graph 100, a true roughness as indicated by graph 102, and graph 104 depicts a roughness multiplied by 0.5. In general, inversion deteriorates towards the heel of the well, where pressure gradient is the greatest, and the error in roughness translates into error in the calculated permeability.

Figure 11:
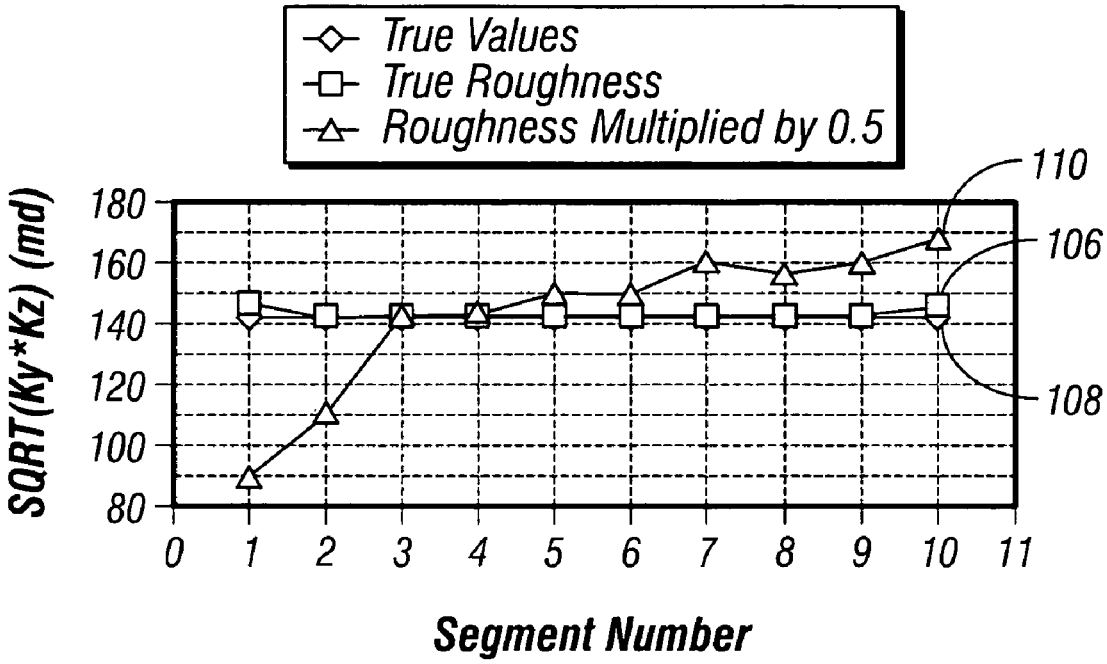

The effect is less pronounced when the magnitude of the pressure drop in the wellbore is smaller. For example, FIG. 10 depicts the permeability profile within perfect knowledge of wellbore hydraulics with a liner that has an inner diameter of 0.25 feet. FIG. 11 depicts the estimation of permeability profile within perfect knowledge of wellbore hydraulics when the liner has a larger 0.45 feet inner diameter. More specifically, FIG. 11 shows a graph 108 depicting true values, a graph 106 depicting true roughness, and a graph 110 depicting the roughness multiplied by 0.5. As seen, less variation occurs with a larger liner inner diameter.

Figure 12:
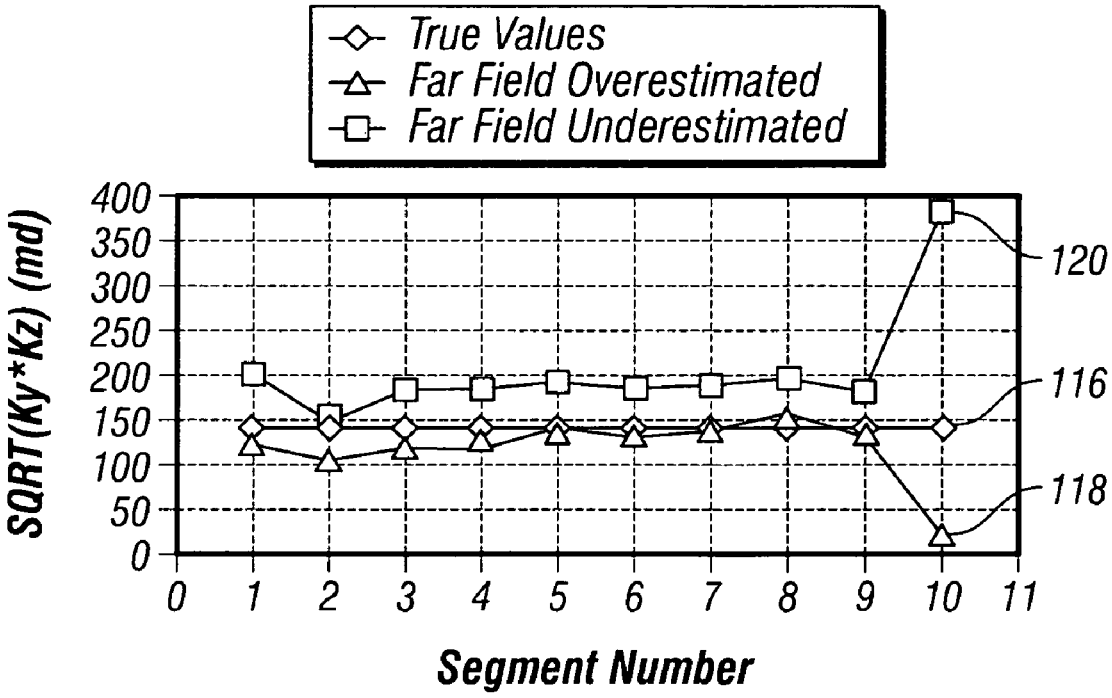
FIG. 12 is a graph depicting estimations of permeability profiles with imperfect knowledge of reservoir permeability field without using a far-field multiplier.
Figure 13:
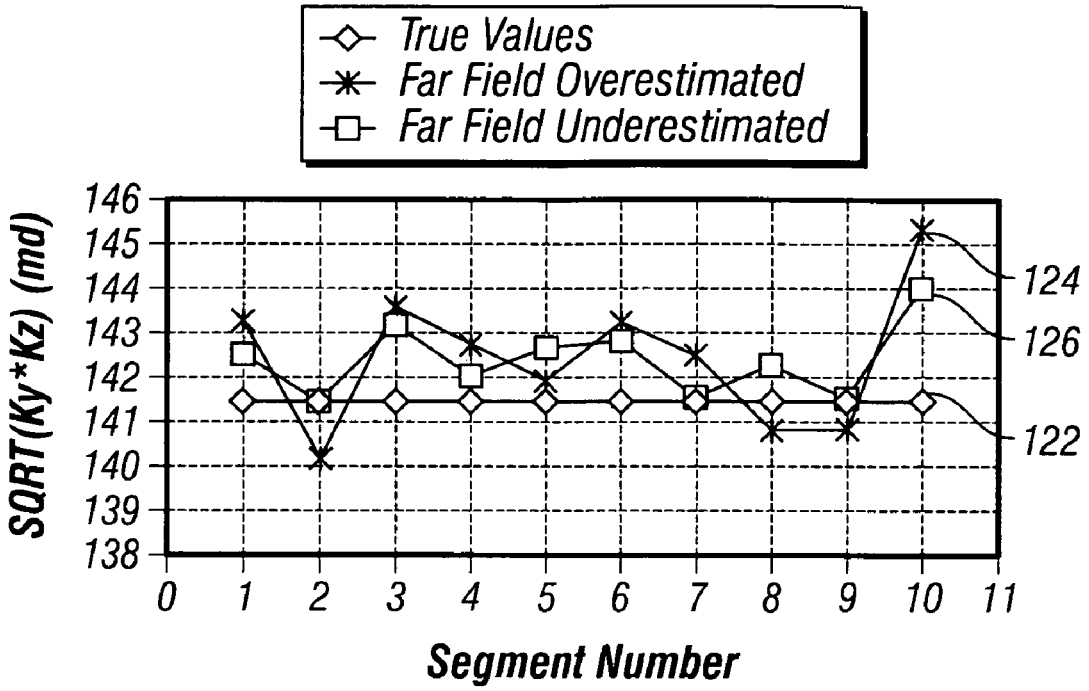
FIG. 13 is a graph depicting estimations of a permeability profile with imperfect knowledge of reservoir permeability field using a far-field multiplier.

FIG. 12 depicts the inversion of the five-node configuration in a uniform permeability field, but when reservoir permeability is imperfectly known. Graph 116 depicts the true values, graph 118 depicts a far-field overestimation, and graph 120 depicts a far-field underestimation. As before, the horizontal and vertical permeabilities are 200 and 100 md. In the inversion, however, the initial guess of the reservoir permeability field is either an overestimate (500, 250 md) or an underestimate (100, 50 md). The initial guess of the wellbore gridblock permeabilities is as before (150, 50 md). The inversion nevertheless produces a fair estimation of the near-wellbore permeability distribution The error of the far-field permeability is attenuated, such that a gross overestimation of the far-field results in a smaller underestimation of the near-field (and conversely). This is, however, true because the inversion is based on early time data. This problem can be overcome by inverting for a far-field permeability multiplier, as well as the wellbore gridblock permeability distribution, which generates the least mismatch between measured and computed pressures. FIG. 13 depicts the inversion when the multiplier technique is used. Graphs 122, 124, and 126 depict the true values, far-field overestimation values, and far-field underestimation values, respectively.

Figure 14:
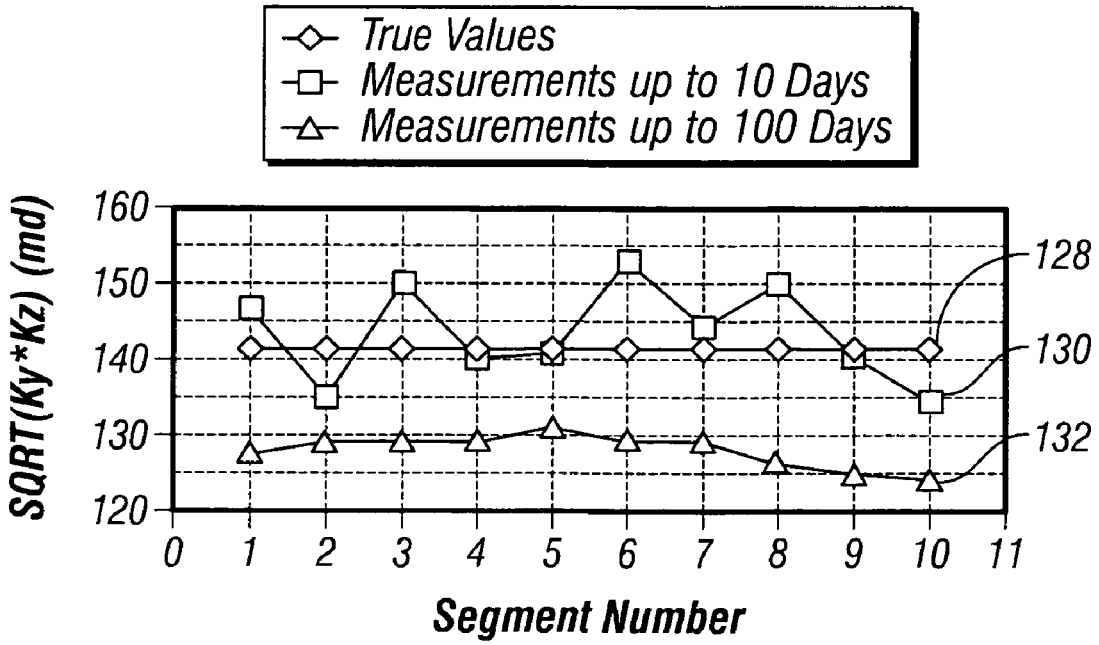
FIG. 14 is a graph showing estimations of a permeability profile with imperfect knowledge of relative permeability function.
Figure 15:
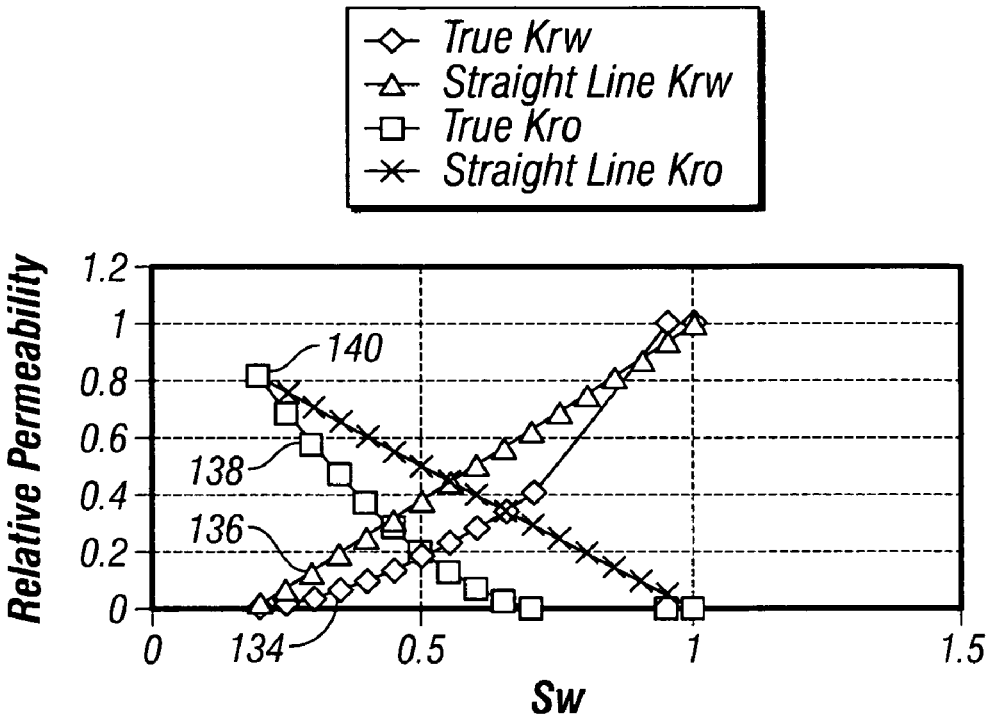
FIG. 15 is a graph depicting true and assumed relative permeability curves for oil and water.
Figure 16:
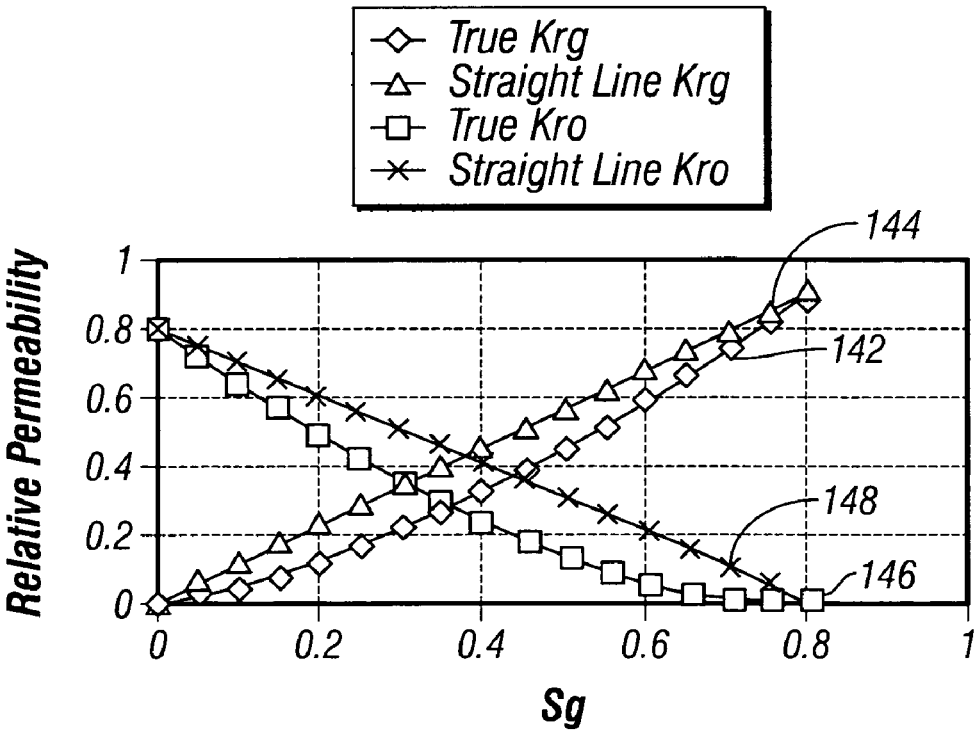
FIG. 16 is a graph depicting true and assumed relative permeability curves for gas and oil.

FIG. 14 depicts the inversion of the five-node configuration in a uniform permeability field when there is imperfect knowledge of the relative permeability function. Graph 128 depicts the true values, graph 130 depicts measurements up to 10 days after initial production, and graph 132 depicts measurements up to 100 days after initial production. Straight-line relative permeability functions are used for inversion, whereas the true relative permeability is a concaved Corey-type function, as depicted in FIGS. 15 and 16. More specifically, FIG. 15 depicts graphs 134, 136, 138, and 140 showing the true $k_{rw}$ permeability, straightline $k_{rw}$ permeability, true $k_{ro}$ permeability, and straightline $k_{ro}$ permeability, respectively. FIG. 15 depicts the relative permeability of oil and water. FIG. 16 depicts the relative permeabilities for oil and gas. FIG. 16 depicts graphs 142, 144, 146, and 148 of the true $k_{rg}$ permeability, straightline $k_{rg}$ permeability, true $k_{ro}$ permeability, and straightline $k_{ro}$ permeability, respectively. Therefore, the quality of the inversion is dependent on the knowledge of relative permeability. One way to improve the inversion is to invert pressure profiles at earlier times, when the relative permeability effects are less pronounced.

Figure 17:
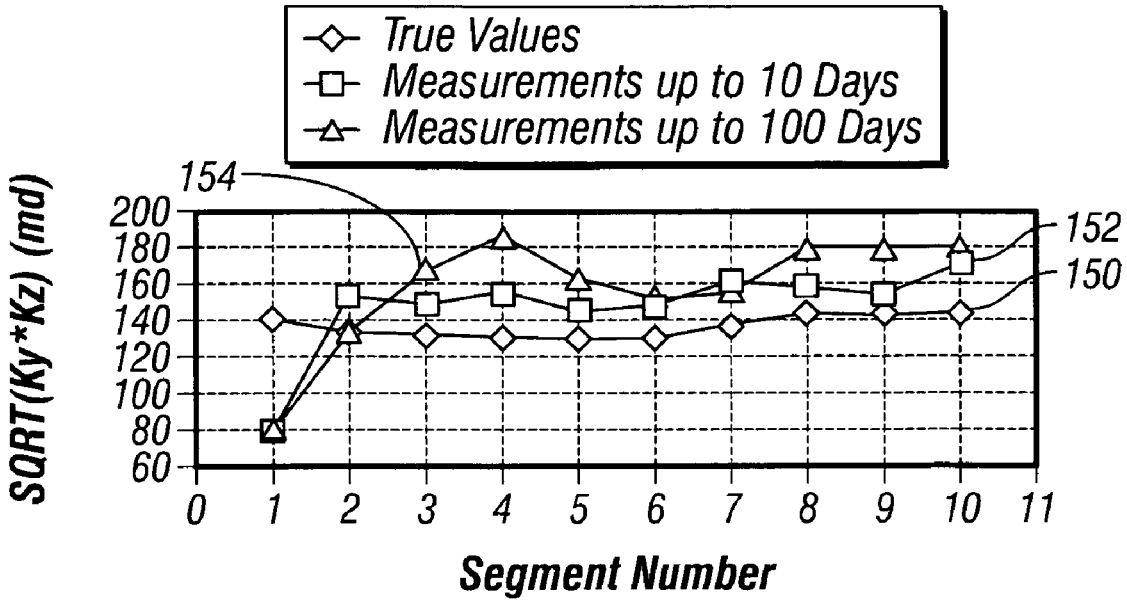
FIG. 17 is a graph showing estimations of permeability profiles with the combined effects of uncertain wellbore hydraulics, reservoir permeability field, and relative permeability function.

FIG. 17 depicts the inversion of the five-node configuration with "drift-free" measurements, but when the combined effects of error in liner roughness, far-field permeability, and relative permeability function are taken into account. More specifically, FIG. 17 depicts graphs 150, 152, and 154 showing the true $k_x$, and measurements up to 10 and 100 days, respectively. The true permeability profile is moderately heterogeneous with variation of normal permeabilities along the length of the well. The inversion result is a fair characterization of the true permeability profile. This is partly because the influencing parameters can have opposite effects on the permeability estimation.

Figure 18:
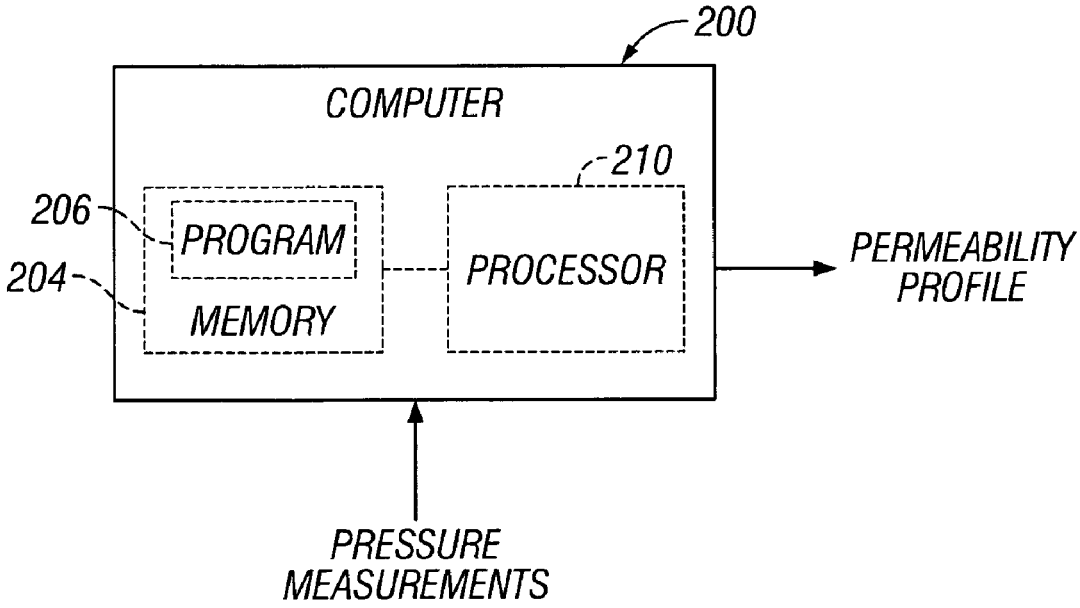
FIG. 18 is a block diagram of a computer according to an embodiment of the invention.

Referring to FIG. 18, in some embodiments of the invention, the modelling and inversion described above may be performed by program instructions 206 that are stored in a memory 204 of a computer 200. In this manner, the computer 200 may include a processor 210 (a microprocessor, for example) that executes the program 206 for purposes of producing a permeability profile from pressure measurements. As discussed above, the generation of the permeability profile may be aided by initial parameters that are "guesses" of the permeability profile and input into the computer 200 by the user.

While the present invention has been described with respect to a limited number of embodiments, those skilled in the art, having the benefit of this disclosure, will appreciate numerous modifications and variations therefrom. It is intended that the appended claims cover all such modifications and variations as fall within the scope of the appended claims.

What is claimed is:

1. A method usable with a subterranean well, comprising:
obtaining pressure measurements along a wellbore during flowing of the well without intervening in the well; and
using a model to determine from the pressure measurements a distribution of a permeability profile in the vicinity of the well, wherein the using comprises:
providing an estimation of the distribution to the model; and
refining the estimation using the pressure measurements.

2. The method of claim 1, further comprising:
deploying a sensor into the well; and
obtaining the pressure measurements from the sensor.

3. The method of claim 2, wherein the deploying comprises deploying an optical fiber into the well.

4. The method of claim 1, further comprising placing a subsequent well in response to the determination of a specific type of distribution of the characteristic.

5. The method of claim 1, wherein the obtaining comprises using sensors that are permanently mounted in the well.

6. A method usable with a subterranean well, comprising:
obtaining pressure measurements along a wellbore during flowing of the well without intervening in the well; and
using a model to determine from the pressure measurements a distribution of a permeability profile in the vicinity of the well, wherein using comprises:
providing an estimation of the distribution to the model; and
refining the estimation using the pressure measurements, wherein the refining comprises performing an inversion of a connection factor that interrelates the distribution to the pressure measurements.

7. The method of claim 6, further comprising:
deploying a sensor into the well; and
obtaining the pressure measurements from the sensor.

8. The method of claim 7, wherein the deploying comprises deploying an optical fiber into the well.

9. The method of claim 6, further comprising treating the well in response to the determined distribution of the characteristic.

10. The method of claim 6, further comprising placing a subsequent well in response to the determination of a specific type of distribution of the characteristic.

11. The method of claim 6, wherein the obtaining comprises using sensors that are permanently mounted in the well.

12. A method usable with a subterranean well, comprising:
obtaining pressure measurements along a wellbore during flowing of the well without intervening in the well;
using a model to determine from the pressure measurements a distribution of a permeability profile in the vicinity of the well, wherein using comprises:
providing an estimation of the distribution to the model; and
refining the estimation using the pressure measurements; and
treating the well in response to the determined distribution of the characteristic.

* * * * *